US006119604A

United States Patent [19]

Thomsen

[11] Patent Number: 6,119,604

[45] Date of Patent: Sep. 19, 2000

[54] PALLET HAVING LATERAL SUPPORTS, AND USE THEREOF

[76] Inventor: Claus Thomsen, Højvang 4, DK-5560, Aarup, Denmark

[21] Appl. No.: 09/269,687

[22] PCT Filed: Sep. 30, 1997

[86] PCT No.: PCT/DK97/00413

§ 371 Date: Apr. 29, 1999

§ 102(e) Date: Apr. 29, 1999

[87] PCT Pub. No.: WO98/14380

PCT Pub. Date: Apr. 9, 1998

[30] Foreign Application Priority Data

Sep. 30, 1996 [DK] Denmark ..... 1071/96

[51] Int. Cl.[7] ..... B65D 19/44

[52] U.S. Cl. ..... 108/55.1; 108/57.17

[58] Field of Search ..... 108/55.1, 55.3, 108/55.5, 56.1, 57.17; 206/600

[56] References Cited

U.S. PATENT DOCUMENTS

| | | | |
|---|---|---|---|
| 2,471,693 | 5/1949 | Lilienfeld | 108/55.1 |
| 3,626,872 | 12/1971 | Cully | 108/55.1 |
| 4,068,599 | 1/1978 | Sapp et al. | 108/55.1 |
| 4,571,141 | 2/1986 | Gieson | 108/55.1 X |

FOREIGN PATENT DOCUMENTS

| | | | |
|---|---|---|---|
| 692071 | 8/1964 | Canada | 108/55.3 |

*Primary Examiner*—Janet M. Wilkens
*Attorney, Agent, or Firm*—Merchant and Gould P.C.

[57] ABSTRACT

A pallet including a load-receiving support with supporting joists, the pallet being provided with removable lateral supports. The pallet is characterized in that the load-receiving surface is provided with indentations of a configuration that substantially corresponds to the shape of the removable lateral supports. Such a pallet can be used in the stacking and distribution of Christmas trees and decorative greenery.

8 Claims, 3 Drawing Sheets

PALLET HAVING LATERAL SUPPORTS, AND USE THEREOF

FIELD OF THE INVENTION

The present invention relates to a pallet comprising a load receiving surface with supporting joists, said pallet having removable lateral supports that protrude upwardly from said load receiving surface.

BACKGROUND OF THE INVENTION

Pallets are widely used for packaging and stacking of various kinds of goods, typically individual items or packages that may be stacked in a stable manner or fixated relative to the pallet by winding with e.g. steel or plastics bands. Pallets are advantageous for transportation since they have modular dimensions and are thus configured for optimal utilisation of the space in trucks, containers or cargo wagons. Pallets are often involved throughout the entire distribution chain, all the way from manufacturer to consumer.

Various pallet dimensions and types have been developed, and in particular for use in connection with the production of Christmas trees and decorative greenery, a pallet system has been developed that consists of a so-called transport pallet on which Christmas trees and decorative greenery are transported to the retailer, and a so-called forest pallet on which the less solid transport pallet is positioned during its transport and packaging on the growth site in the forest. This system is described in further detail in DK patent No. 169 147, and in addition to said pallets it also describes a method of packaging Christmas trees and decorative greenery in a compressed manner.

In order to minimise packaging waste, it is a current desire that pallets are to be returned to the manufacturer following discharge of their loads at the retailer's. However, the above-described transportation pallet is not very suitable for reuse since, although removable, its lateral elements cannot be packed away during the transport back to the manufacturer and therefore the empty pallet and its lateral elements take up comparatively much space during this return transport.

However, the transport pallet used in practice is forwarded to the retailer without use of lateral supports, the pallet and the Christmas trees or the decorative greenery merely being wound with a plastics or steel band. However, this presents the drawback at the retailer's that all Christmas trees or all the decorative greenery is discharged from the pallet at the same time when the windings are cut. However this is contrary to the retailer's wish that discharge from the pallet may be effected continuously.

SUMMARY OF THE INVENTION

It is the object of the present invention to provide a pallet with lateral supports which may be packed away thereby accomplishing a pallet which does not consume considerably more space than an empty pallet without lateral supports. In the packed state, the lateral supports must moreover be so positioned that they are not readily able to slide away from the pallet during transport.

This object is obtained by configuring the pallet described above in such a manner that the load receiving surface is provided with indentations of a configuration that corresponds substantially to the shape of the removable lateral supports, whereby said lateral supports may be arranged in the indentations when removed from the pallet.

By providing the load-receiving surface of the pallet in this manner, it is possible to arrange the lateral supports in the indentations of the load-receiving surface where they will be more or less secured.

By configuring the pallet in such a manner that the lateral supports consist of posts, and by providing the load-receiving surface with longitudinally extending grooves of a width that corresponds to the width of the posts, it is obtained that the posts may be arranged in the grooves of the load-receiving surface and thus be secured during transport of the unloaded pallet.

According to a particularly simple embodiment, the posts consist of wooden planks whereas the load-receiving surface consists of corresponding wooden planks arranged at mutual distances that correspond to the width of the planks. Hereby the grooves in the load-receiving surface are constituted by the spaces between the planks of the load-receiving surface.

According to a preferred embodiment of the invention, the lateral supports may be mounted loosely on the sides of the pallet, and when mounted they occupy a position in their free state where they incline away from the pallet.

By connecting the lateral supports mounted on each side of the pallet with e.g. bars, strings or chains it is obtained, on the one hand, that the lateral supports are prevented from flexing outwards, and on the other, that the lateral supports are further squeezed home in the mounting fittings on the pallet.

The mounting of the lateral supports is preferably effected by the pallet being provided with parts that protrude from the sides, said parts delimiting an upwardly open cavity, and by the lower ends of the lateral supports being provided complementary with said cavity.

Hereby the lateral supports may be mounted on the sides of the pallet merely by shifting their lower ends downwards into the upwardly facing opening on the sides of the pallet.

According to a particularly simple embodiment of the protruding parts, they consist of a U-shaped fitting secured to the ends of the joists that support the load-receiving surface.

The protruding parts may also consist of the ends of the joists that support the pallet, thereby allowing the upwardly opening cavity to consist of a bore. In this embodiment the lateral supports may advantageously consist of bars/tubes of steel.

The invention also relates to the use of a pallet as described for use in the stacking and distribution of Christmas trees and decorative greenery.

The invention will now be explained in further detail with reference to the drawings, wherein

DETAILED DESCRIPTION

Figure 1:
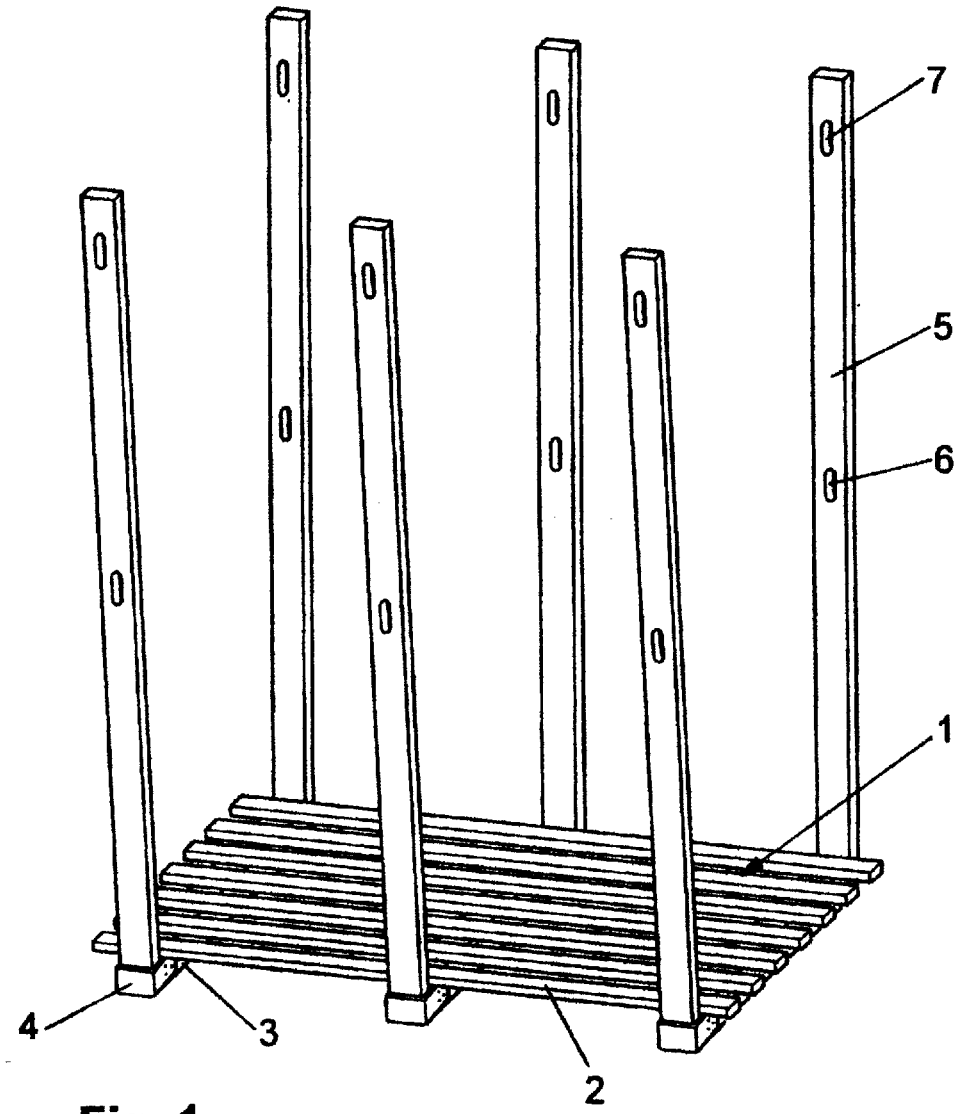
FIG. 1 illustrates a pallet according to the invention in a preferred embodiment with its lateral supports in their mounted state.

The pallet has a load-receiving surface 1 consisting of seven longitudinally extending planks 2 in the embodiment shown. The planks 2 are secured by means of nails or the like to supporting joists 3 that extend transversally to the planks 2. In the embodiment shown the pallet is provided with three joists 3.

At each end of the joists 3, a U-shaped fitting 4 is mounted which will appear more clearly from FIGS. 2 and 4 and which will be subject to more detailed discussion below.

In the U-shaped fitting 4, upwardly protruding lateral supports 5 in the form of planks are mounted, the dimensions of which correspond to the dimensions of the planks 2 on the load-receiving surface 1.

Centrally on the lateral supports 5 a through-going elongated hole 6 is provided, and a corresponding hole 7 is provided at the uppermost extremities of the lateral supports. The function of these holes will be described in detail below.

Figure 2:
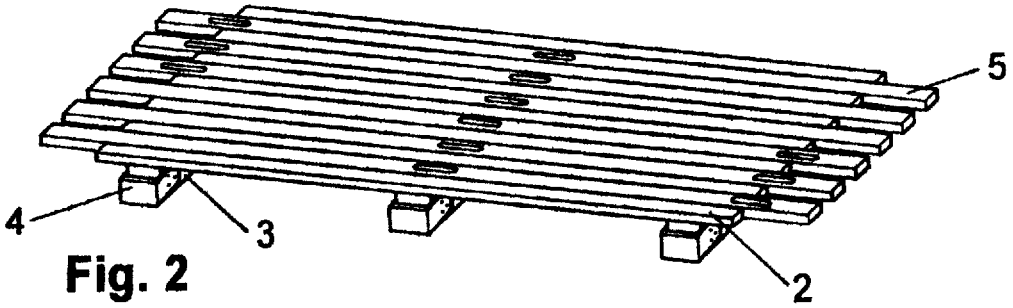
FIG. 2 illustrates the same pallet as FIG. 1 in its collapsed state.

FIG. 2 illustrates the same pallet as FIG. 1, only in its collapsed state.

Since the distance between the planks 2 of the load-receiving surface 1 corresponds to the width of the lateral supports 5, the lateral supports 5 may be laid down between the planks 2 of the load-receiving surface 1 so as to rest upon the supporting joists 3. Since the dimensions of the lateral supports 5 and the planks 2 in the embodiment shown are identical, the surface of the collapsed pallet becomes completely planar.

According to an alternative embodiment, the lateral supports 5 and the planks 2 may have different dimensions, e.g. as a consequence of the various load requirements made to load-receiving surface and lateral supports, respectively, whereby the surface of the collapsed pallet is not completely planar but will assume a height corresponding to the widest portions of lateral supports 5 and planks 2, respectively.

As will also appear, the lateral supports 5 in the preferred embodiment are longer than the pallet and therefore they extend beyond the pallet in its collapsed state.

When the pallet is to be packed with e.g. Christmas trees 8, the first step is to mount all the lateral supports 5 in the U-shaped fittings 4 whereby the appearance shown in FIG. 1 is imparted to the pallet.

Figure 3:
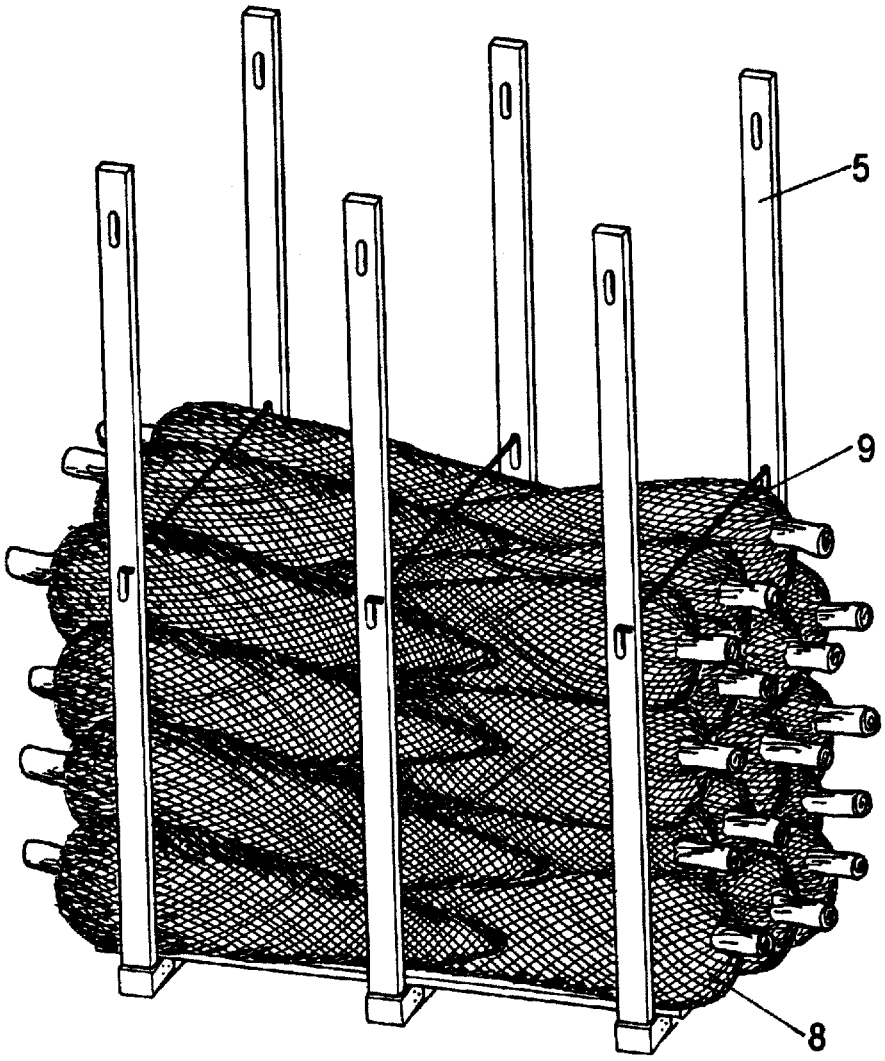
FIG. 3 illustrates a pallet semi-loaded with Christmas trees.

The Christmas trees 8 that have previously been pulled through a nylon net are subsequently arranged on the pallet with their tops being oriented towards the centre of the pallet and the sawed-off trunks being oriented towards the extremities of the pallet as shown in FIG. 3.

Thus the central lateral supports 5 support the tops of the Christmas trees 8 whereas the lateral supports at the ends of the pallet support the Christmas trees 8 at their thickest portion which is important in order to avoid that any parts of the Christmas trees protrude beyond the total width of the pallet.

When the pallet is approximately semi-loaded, i.e. when the Christmas trees 8 reach the through-going, elongated holes 6 in the lateral supports 5, bars 9 are mounted with bent extremities through the holes 6 in the opposed lateral supports 5 for stabilisation thereof prior to further loading of the pallet.

Since the lateral supports 5 are exposed to outward pressure from the Christmas trees 8 loaded thereon, the bars 9 are secured in the holes 6 via their bent extremities.

When the rods 9 are mounted in the holes 6, the pallet may be further loaded with Christmas trees until they reach the upper, elongated holes 7, following which bars are mounted therein in a manner similar to that of the bars 9 in the holes 6.

This further loading of the pallet effects a compression of the Christmas trees already packed and therefore it is important that the holes 6 are elongate, since this configuration allows the extremities of the bars 9 to slide downwards relative to the lateral supports 5.

Unloading of the pallet is accomplished in the opposite sequence, the bars 9 in the upper, elongate holes 7 being first removed. Half of the packed Christmas trees 8 may now be discharged following which the bars 9 in the elongated holes 6 are removed and the pallet is unloaded completely. Since the lateral supports 5 continue to support the Christmas trees 8 on the pallet during tho unloading procedure, it is possible to continuously unload the pallet which is not an option with the prior art pallets that are emptied all at once when the band windings are removed.

If the pallet according to the invention is to be unloaded all at once, all it takes is to remove the lateral supports 5. If the lateral supports are removed at one side only, unloading of the pallet from one side is accomplished.

Figure 4:
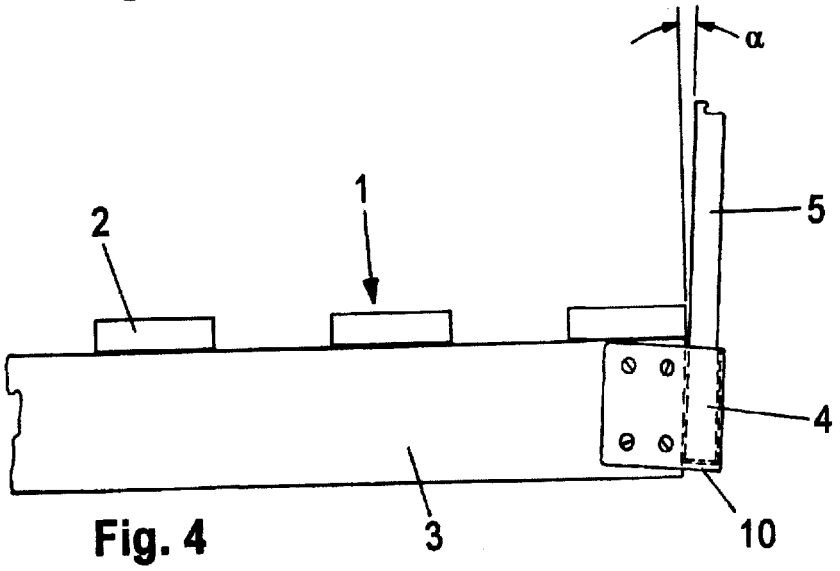
FIG. 4 is a detailed view of the mounting of the lateral supports on the pallet.

FIG. 4 is an end view of a part of the pallet in a preferred embodiment. The figure illustrates how the U-shaped fittings 4 are configured and attached to the extremity of one of the joists 3. Above the joists 3, planks 2 forming the load-receiving surface 1 are secured by means of nails or the like.

In the protruding, U-shaped fitting 4, a lateral support 5 is mounted in the form of a plank, as shown in FIG. 1. In the embodiment shown, the U-shaped fitting 4 is provided with a bottom 10 on which the lateral support 5 rests when mounted in the U-shaped fitting 4. However, nothing prevents the U-shaped fitting 4 from forming a through-going opening which allows the lateral support 5 to extend completely through the U-shaped fitting 4 and rest with its extremity on the support on which the pallet is arranged.

The end of the joist 3 and the outermost extremity of the U-shaped fitting 4 is so configured that the lateral support 5 tapers outwards relative to the pallet with an angle $\alpha$ that is typically comprised within the range of from 2° to 5°.

By configuring the U-shaped fitting 4 in this manner, the lateral support 5 is squeezed firmly in when the bars 9 are mounted in the holes 6 and 7, these bars 9 hereby biasing the lateral supports inwards at the middle and at the top, thereby causing the lateral supports to be squeezed firmly into the tapering, U-shaped sittings 4. Hereby a pallet is accomplished which is, in its loaded state, very stable, and further winding of the loaded pallet with steel or plastics bands is no longer required.

Figure 5:
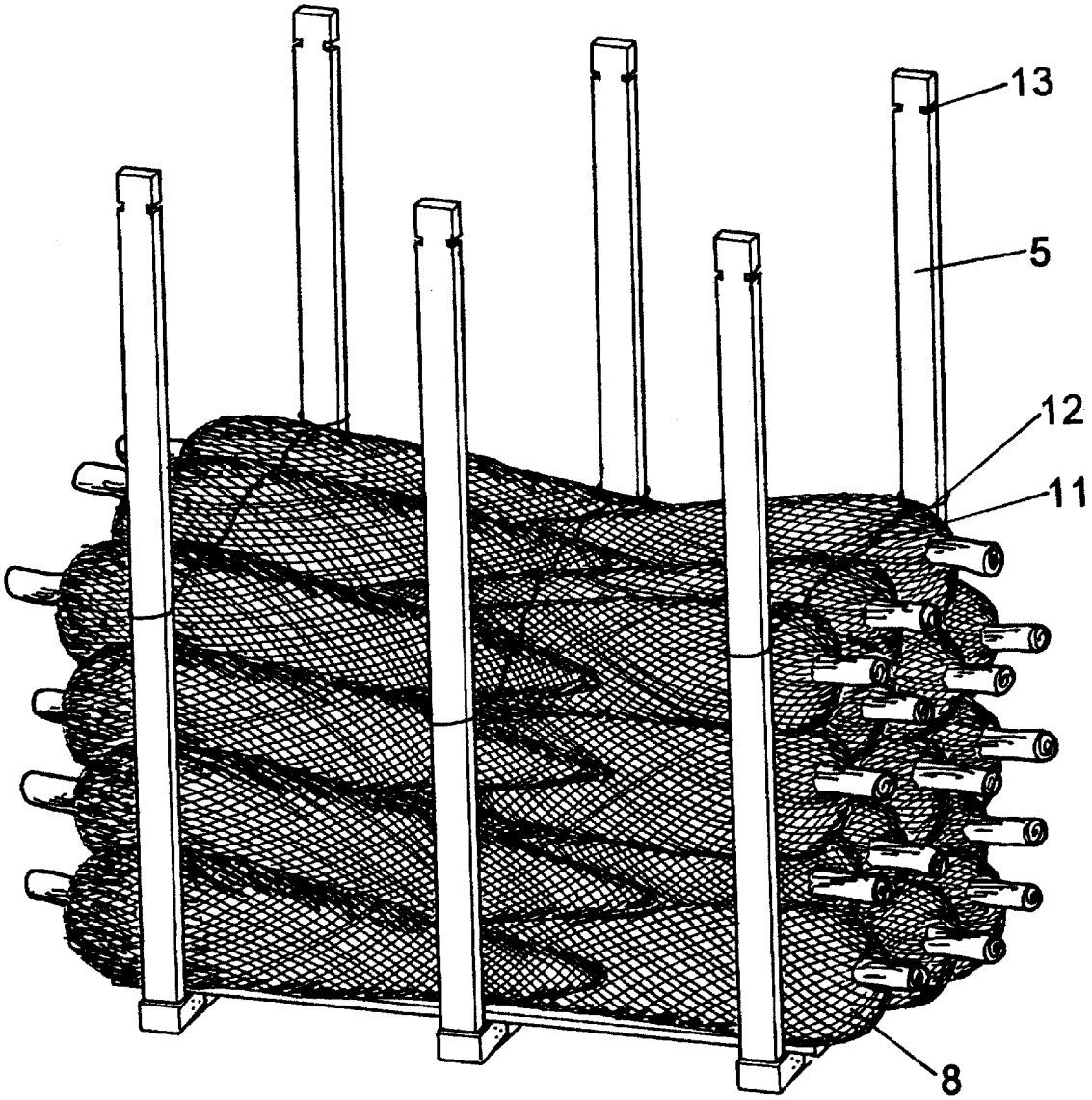
FIG. 5 illustrates a pallet semi-loaded with Christmas trees according to an alternative embodiment.

FIG. 5 illustrates an alternative embodiment of a pallet according to the invention wherein strings 11 are used instead of bars 9 as connecting means between opposed lateral supports 5. The strings 11 are provided with closed loops 12 at their ends, said loops 12 having such dimension as to be fitted around the lateral supports 5. Loading of the pallet is carried out in the same manner as when bars 9 are used as connecting means, and the use of strings 11 presents the advantage that they may be arranged more randomly since they do not depend on holes 6,7 in the lateral supports 5. Moreover, the strings 11 are more adaptive relative to the trees 8 whereby the risk of damaging the trees is minimised.

As shown in FIG. 5, each of the lateral supports 5 is provided with two recesses 13 at its uppermost end, said recesses 13 serving to secure the top string when the pallet is fully loaded.

The pallet is preferably configured for use in connection with a machine that compresses the Christmas trees 8 when they are loaded onto the pallet. In the embodiment of the pallet shown, the machine should preferably be provided with additional lateral supports for the pallet during the compression procedure in order to ensure that the lateral supports S can tolerate the pressure they are exposed to during the compression.

The pallet may also be used in a completely manual loading procedure, since a frame may advantageously be used therefor which may be arranged around the pallet and which partly braces the lateral support 5 to avoid flexing and partly prevents the Christmas trees a and the decorative greenery from sliding during the loading procedure. The frame may have a height e.g. corresponding to about one third of the height of the lateral supports, and during the loading it is shifted upwards along the lateral supports 5 in pace with loading of the pallet.

The pallet according to the invention may have many configurations in addition to the one shown in FIGS. 1 through 5.

For instance, the pallet could be configured as a steel pallet with lateral supports also made of steel, or it could consist of a combination of steel and wood.

For instance, the protruding parts of the pallet for mounting of lateral supports 5 may consist of the extremities of the supporting joists 3 in each of which a hole has been bored for a lateral support 5 consisting of a bar or a tube of steel.

The rigid bars 9 or strings 11 may also be replaced by e.g. chains, the only condition being that they are configured to be able to slide upwards and downwards in the lateral supports 5 to absorb the pull generated therein when mounted between the opposed lateral supports.

What is claimed is:

1. A pallet comprising a load-receiving surface defining a longitudinal and a transverse extension of the pallet and a plurality of lateral supports protruding upwardly from said load-receiving surface along said longitudinal extension of the pallet, wherein the load-receiving surface comprises indentations of a configuration that substantially corresponds to the shape of the lateral supports, the pallet further comprising a plurality of supporting joists arranged in said transverse extension of the pallet wherein the lateral supports are removably secured to the pallet at an end of each joist, wherein the lateral supports can be arranged in said indentations when dismounted from the pallet, wherein the lateral supports can be mounted loosely on the sides of the pallet and that, upon mounting, they have an inclination away from the pallet in their free state.

2. A pallet according to claim 1, wherein the lateral supports comprise posts and the load-receiving surface is provided with longitudinally extending grooves, the width of which corresponds to the width of the posts.

3. A pallet according to claim 2, wherein the posts comprise wooden planks, and the load-receiving surface comprises corresponding wooden planks arranged at mutual distances that correspond to the width of the planks.

4. A pallet according to claim 1, further comprising connecting elements that connect the lateral supports mounted on each side of the pallet.

5. A pallet according to claim 4, wherein the connecting elements comprise rigid bars that are arranged for engaging with the lateral supports.

6. A pallet according to claim 4, wherein the connecting elements comprise strings whose ends are configured as a closed loop that may pass downwards over the lateral supports.

7. A pallet comprising a load-receiving surface defining a longitudinal and a transverse extension of the pallet and a plurality of lateral supports protruding upwardly from said load-receiving surface along said longitudinal extension of the pallet, wherein the load-receiving surface comprises indentations of a configuration that substantially corresponds to the shape of the lateral supports, the pallet further comprising a plurality of supporting joists arranged in said transverse extension of the pallet wherein the lateral supports are removably secured to the pallet at an end of each joist, wherein the lateral supports can be arranged in said indentations when dismounted from the pallet, wherein the pallet is provided with elements comprising a U-shaped fitting, attached to the ends of the supporting joists, that protrude from the side of said pallet, said elements delimiting an upwardly open cavity, wherein the lateral supports are configured to be complementary with said cavity.

8. A pallet comprising a load-receiving surface defining a longitudinal and a transverse extension of the pallet and a plurality of lateral supports protruding upwardly from said load-receiving surface along said longitudinal extension of the pallet, wherein the load-receiving surface comprises indentations of a configuration that substantially corresponds to the shape of the lateral supports, the pallet further comprising a plurality of supporting joists arranged in said transverse extension of the pallet wherein the lateral supports are removably secured to the pallet at an end of each joist, wherein the lateral supports can be arranged in said indentations when dismounted from the pallet, wherein the pallet is provided with elements comprising upwardly open cavities in the ends of the joists, wherein the lateral supports are configured to be complementary with said cavity.

* * * * *